United States Patent [19]

Lin

[11] Patent Number: 4,480,668

[45] Date of Patent: Nov. 6, 1984

[54] SCREW DRIVER KIT

[76] Inventor: Ching-Hsiung Lin, No. 47, La. 5, Shang Jen St., Kaohsiung, Taiwan

[21] Appl. No.: 447,686

[22] Filed: Dec. 7, 1982

[51] Int. Cl.[3] ..... B25G 1/08

[52] U.S. Cl. ..... 145/63

[58] Field of Search ..... 145/63, 62

[56] References Cited

U.S. PATENT DOCUMENTS

| | | | |
|---|---|---|---|
| 148,888 | 3/1874 | Kidder | 145/63 |
| 728,188 | 5/1903 | Barstad | 145/63 |
| 2,472,392 | 6/1949 | Alexander | 145/62 |
| 2,629,413 | 2/1953 | Stettler | 145/63 |
| 3,194,286 | 7/1965 | Wagner | 145/63 |

FOREIGN PATENT DOCUMENTS

| | | | |
|---|---|---|---|
| 482753 | 4/1938 | United Kingdom | 145/62 |

*Primary Examiner*—Frederick R. Schmidt
*Assistant Examiner*—J. T. Zatarga
*Attorney, Agent, or Firm*—Holman & Stern

[57] ABSTRACT

A screw driver kit has four driver blades in a magazine tube inside the handle. The tube has four separate holes for each driver blade and can be turned around by pushing with fingers so that each hole can be aligned with the central hole of the driver blade holder whereby each driver blade falls down into this hole and protrudes out of the driver blade holder if the handle is tilted down. A clamping head mounted on the driver blade holder is manipulated with fingers. When the driver blade completely sticks out of the driver blade holder, the clamping head is released back to its normal position and then the driver blade is caught steadfast by three steel balls which operate in ball holes in the lowest part of the driver blade holder. To change a driver blade, the clamping head is released and the tool is tilted upward, whereby the driver blade will drop by its own weight into the straight hole of the magazine tube. The tube is then rotated to choose another driver blade.

2 Claims, 15 Drawing Figures

A–A

SCREW DRIVER KIT

This invention concerns about a screw driver kit.

This new screw driver kit has four driver blades hidden in a tube inside the handle; the tube has four seperate holes for each driver blade to hide in and can be turned around by pushing with fingers. Each hole can be aligned with the central hole of the driver blade holder, and each driver blade can falls down into this hole and protrudes out of the driver blade holder if the handle is tilted down forward and the pinching head combined around the driver blade holder is pushed right with fingers.

When the driver blade completely sticks out of the driver blade holder, the pinching head is released back to its normal position and then the driver blade is caught steadfast by three steel balls which sit in the ball holes in the lower part of the driver blade. Now this driver is ready for use.

To change a driver blade, we push the pinching head right and tilt it upward, and the driver blade will drop down by its own weight into the straight hole of the tube. Then we push around the tube choosing another driver blade and let it fall down and protrude out of the driver blade holder, which is to be released back to the left-to its normal position catching the driver blade steadfast.

BACKGROUND OF THE INVENTION

1. Field of the Invention

This invention relates to a screw driver kit of the type having a handle with repleaceable blades therein.

2. Description of the Prior Art

Common screw drivers are generally constructed with a handle and one driver blade of one size and one style. Therefore, a worker often has to carry several or many screw drivers in his work, which is quite inconvenient in conducting his work. Although various kinds of screw drivers with multi-blades have been developed, one blade must be taken off the handle and instead another blade must be put in the handle when necessary to change the size or the style. This process of taking-off and putting-in driver blades involves some inconvenience.

In view of the drawbacks above-mentioned, the inventor, having many years of experience in making tools, has invented this new screw driver kit with multi-tips hidden in the handle.

BRIEF SUMMARY OF THE INVENTION

The invention overcomes these drawbacks by providing a screw driver kit having a magazine in the handle for a plurality of screw driver blades, the magazine being rotatable to selectively align one of the blades with a blade holder on the end of the handle through which a blade is provided for use. A clamping head is provided on the blade holder which is positioned to manipulate clamping balls in holes in the blade holder between clamping and stop positions for the blades. In the clamping position the balls engage in detents on the inner end of each blade and in the stop position the balls retain the blades within the handle. A hole is provided through the finger grip part of the handle to rotate the magazine.

BRIEF DESCRIPTION OF DRAWINGS

In order that this invention can be clearly understood an embodiment thereof will now be described by a way of example with reference to the accompanying drawings wherein.

DESCRIPTION OF PREFERRED EMBODIMENT

Figure 1:
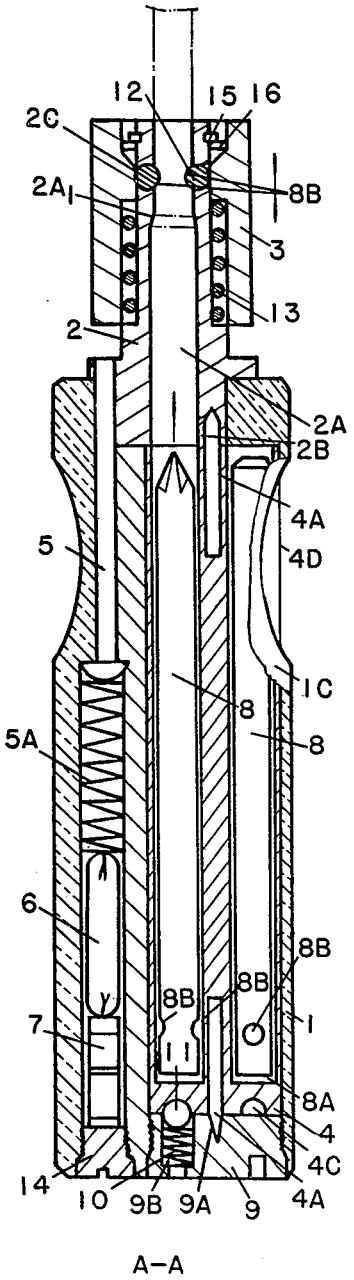
FIG. 1 is a longitudinal cross-sectional view of the screw driver kit of this invention taken along line 1—1 of FIG. 2.
Figure 10:
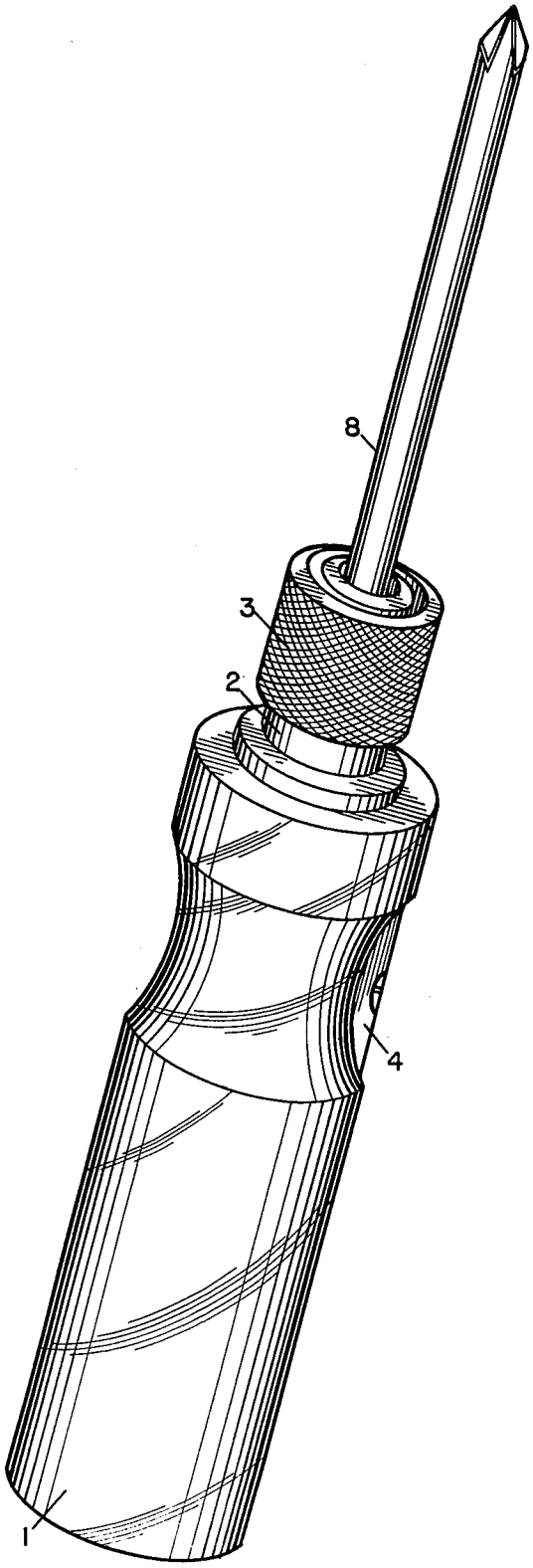
FIG. 10 is a perspective view of the screw driver kit of this invention.
Figure 2:
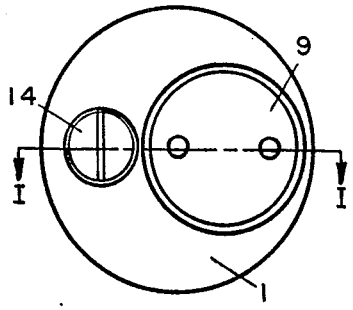
FIG. 2 is a bottom plan view of the screw driver kit in this invention.

This new screw driver kit consists of handle 1, driver blade holder 2, pinching head 3, tube 4, bar 5, spring 5A, small lamp 6, resistance 7, and driver blades 8.

Figure 3A:
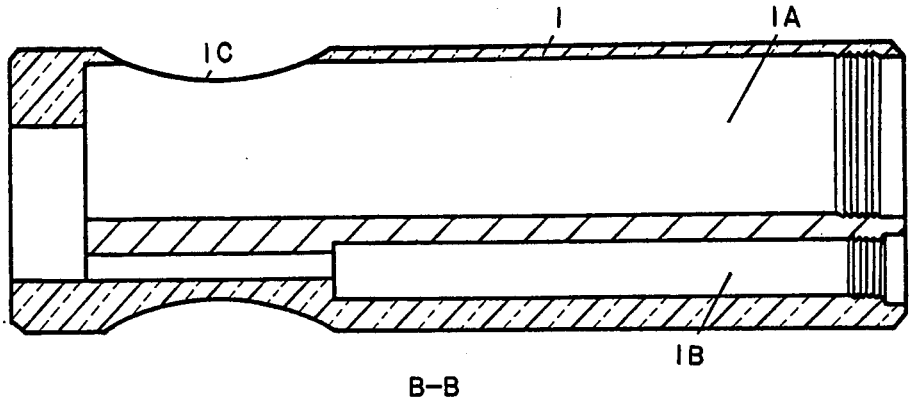
FIG. 3*a* is a cross-sectional view and FIG. 3*b* is a bottom plan view of the handle of this invention.
Figure 3B:
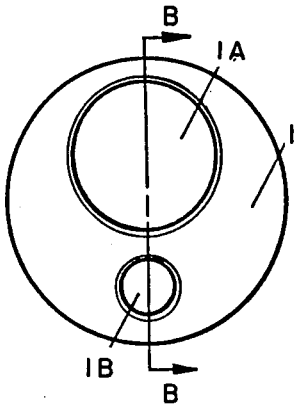

Handle 1 is molded of transparent plastic, and FIG. 3 shows its structure. There are two straight cavities 1A,1B inside handle 1 for magazine tube 4, and bar 5, spring 5A, small lamp 6 and resistance 7 in alignment respectively. At the bottom end of handle 1 are two screw caps 9, 14 covering the two straight cavities, and at the upper end driver blade holder 2 coupled with handle 1 as FIG. 1 shows.

Figure 4A:
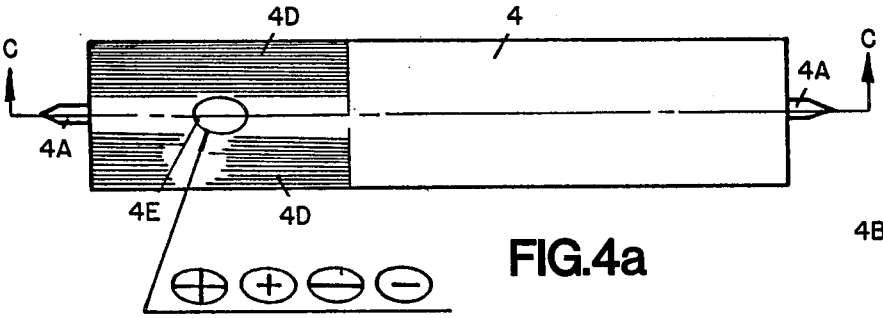
FIG. 4*a* is an elevational view and FIG. 4*b* is a left end view of the tube part of this invention.
Figure 4B:
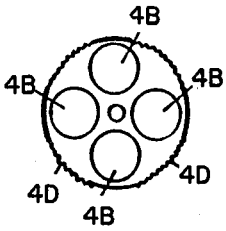
Figure 8:
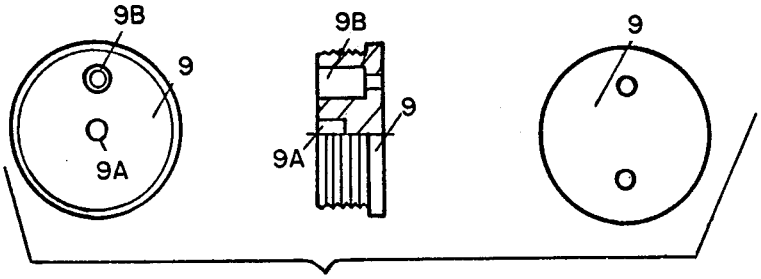
FIG. 8 is a cross-sectional view and right and left side views of the screw cap 9 of this invention.
Figure 5B:
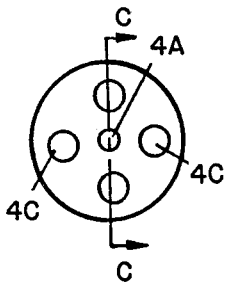
FIG. 5*a* is a cross-sectional view and FIG. 5*b* is a right end view of the tube part of this invention.
Figure 5A:
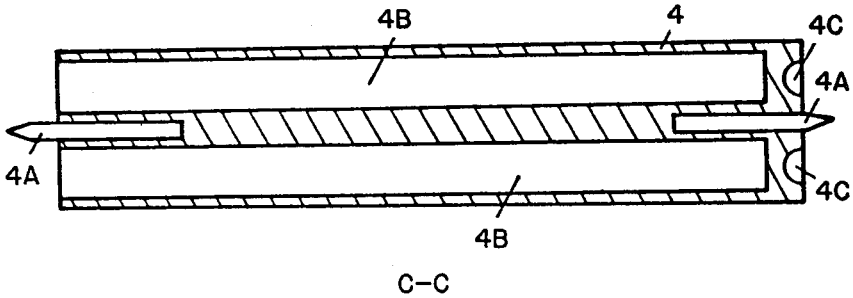

Tube 4, as FIGS. 4 and 5 show, has pointed shaft 4A at both ends; the pointed tip of pointed shaft 4A at the left end is inserted in hole 2B in driver blade holder 2; the pointed tip of pointed shaft 4A at the right is inserted in hole 9A in screw cap 9; thus tube 4 can be turned around by the aid of both pointed shafts 4A when pushed by hand. In tube 4 are four (or more) straight cylindrical holes 4B for driver blades 8 to be held in; on the right end of tube 4 are four (or more) hemispherical recesses 4C in line with straight holes 4B, which steel balls 11 placed between screw cap 9 and tube 4 fit in being pushed by spring 10 in ball hole 9B. When steel ball 11 fits in ball hole 4C, one of straight holes 4B is in line with center hole 2A in driver blade holder 2. Therefore, tube 4 has 4-stage functions of changing driver blades by the aid of steel balls 11, spring 10 and recesses 4C.

In order to push around tube 4C by the fingers after it has been placed in cavity 1B of handle 1, hole 1C is cut in handle 1 near the left end. Then through hole 1C roughened surface 4D is accessible and marks 4E on the left part of tube 4 can be seen; roughened surface 4D is convenient for fingers to engage and push around; marks 4E are to indicate what kind of driver blade, for example, big cross, small cross, big minus, or small minus, is in line with center hole 2A, as FIG. 4 shows.

Figure 6B:
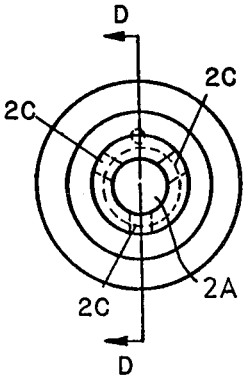
FIG. 6*a* is a cross-sectional view and FIG. 6*b* is a left end view of the driver blade holder of this invention.
Figure 6A:
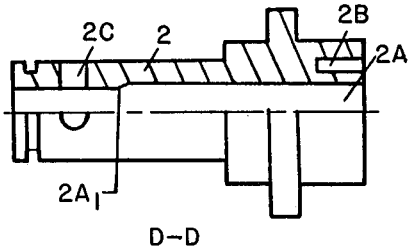
Figure 9:
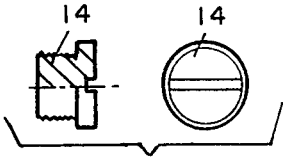
FIG. 9 is a cross-sectional view and right side view of the screw cap 14 of this invention.

FIG. 6 shows the structure of driver blade holder 2 and FIG. 1 shows how it is coupled with handle 1.

Figure 7A:
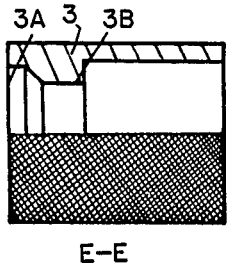
FIG. 7*a* is a cross-sectional view and FIG. 7*b* is a right end view of the pinching head of this invention.
Figure 7B:
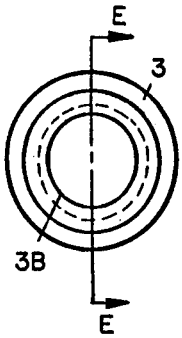

Driver blade holder 2 is made of metal, having center hole 2A for driver blade 8 to pass in. Center hole 2A becomes a little narrower at collar 2Al, between which and the left end of driver blade holder are three ball holes 2C with steel balls 12 placed therein. Then there is clamping head 3 combined together with driver blade holder 2 as FIG. 1 shows. FIG. 7*a* shows its structure which by narrow part 3B urges balls 12 into center hole 2A and prevents driver blade 8 from passing into center hole 2A and sticking out of driver blade holder 2, unless clamping head 3 is pushed toward handle 1. Spring 13 urges clamping head 3 away from handle 1, which causes steel balls 12 to be pushed into center hole 2A in the normal position of clamping head 3, Therefore when clamping head 3 is pushed toward handle 1 and spring 13 is compressed, inside end part 3A moves to the location of steel balls 12 which are no longer pressed by narrow part 3B and lose the function of stopping driver blade 8. So under this condition, driver blade 8 will by its own weight fall down into center hole 2A and protrude out of driver blade holder 2, if handle 1 is tilted downward. When the swelled end 8A of driver blade 8 reaches collar 2Al of center hole 2A, driver blade 8 is stopped there; then releasing head 3 to its normal position causes steel ball 12 to be pressed down by narrow part 3B of clamping head 3 and engages in ball detents 8B on driver blades 8 catching driver balde 8 steadfast. FIG. 7 shows the structure of clamping head 3.

Clamping head 3 can only be moved for a certain distance, after it is assembled around driver blade holder 2 with spring 13 placed between them, because near the outer end of driver blade holder 2 are fixed fastening ring 15 and washer 16 very close to each other, which retains head 3 when released and pushed back by spring 13.

In addition to the different style and size on their tips, driver blades 8 have special charcteristics different from common drivers. In order to coordinate with the three steel balls, around the lower part of driver blades 8 are three ball detents 8B; swelled end 8A of driver blade 8 is useful for being stopped by collar 2Al of driver blade holder 2 when driver blade 8 falls down into center hole 2A.

When it is desired to change a driver blade, holding handle 1 almost upright with clamping head 3 up and pushing head 3 down will allow the driver blade caught by piching head 3 to drop down through center hole 2A and finally into straight hole 4B of tube 4. Then the user need merely push around tube 4 through hole 4D choosing the proper driver blade needed.

I claim:

1. A screw driver kit comprising:

an elongated cylindrically shaped handle;

a longitudinal magazine bore in said handle having its central axis extending parallel to and offset from the central axis of said handle;

a cylindrical magazine rotatably mounted in said magazine bore;

a hole through said handle communicating with said magazine bore so that a portion of the outer surface of said magazine is accessible through said hole for rotating said magazine;

a plurality of screw driver blade bores extending through said magazine parallel to and circumferentially spaced about the axis of rotation of said magazine;

a screw driver blade in each magazine bore, each having a working end and a holding end;

a cylindrical blade holder mounted on one end of said handle;

a blade receiving bore through said blade holder aligned with one of said blade bores in said magazine when said one of said blade bores is in position for use and having a cross-section large enough to slidingly receive the working end of a blade;

a reduced section in said blade holder bore large enough to slidingly receive the working end of said blade and small enough to prevent the holding end thereof from passing therethrough;

a plurality of radial holes through the wall of said blade holder;

a clamping ball radially movable in each radial hole so that in their radially innermost position said clamping balls penetrate into said reduced section into stopping position to prevent the working end of said blade from passing therethrough and into clamping position to clamp the holding end of a blade in position for use;

a plurality of substantially hemispherical detents circumferentially spaced about the outer periphery of the holding end of each blade so that when in position for use said detents are aligned with said clamping balls to receive them when in said clamping position;

a sleeve shaped clamping head slidably mounted on said blade holder for limited axial movement with respect to said blade holder;

an annular internal shoulder on said clamping head positioned to operatively engage and urge said clamping balls radially inwardly into the clamping and stopping positions;

an annulus in said clamping head surrounding said blade holder between said annular shoulder and the end of said clamping head adjacent the handle;

a shoulder on the outer surface of said blade holder adjacent the handle;

a helical coil spring in said annulus between said shoulder on said blade holder and said annular shoulder on said clamping head to resiliently urge said clamping head away from said handle; and a retaining ring on said blade holder positioned between the outer working end thereof and said annular shoulder to operatively engage said annular shoulder to nominally retain the clamping head in the clamping and stopping position;

so that said screw driver blades can be selectively positioned for use by rotating said magazine through said hole in the handle and when aligned with said blade receiving bore in said blade holder, a blade can be fed into or returned from operating position by tilting the working end downwardly or upwardly respectively while said clamping head is moved toward said handle.

2. The screw driver kit as claimed in claim 1 wherein:

said blade holder further comprises, a circular outer peripheral surface having a larger diameter section inserted in said handle and a reduced diameter section forming said shoulder between said sections, a radially extending flange on said larger section, and an axle receiving bore in the inserted end thereof;

a blade holder receiving bore is provided in the working end of said handle to receive said larger diameter section of said blade holder with said flange in abutting relationship with said working end of the handle;

said magazine further comprises a pin axle extending outwardly from each end aligned with the axis of rotation of said magazine, one of said pin axles being rotatably received in said axle receiving bore;

said handle further comprises said magazine bore having an open end through the end of said handle remote from said blade holder, an internal screw thread in said open end, an externally screw threaded plug engaged in and closing said open end, a second axle receiving bore in the inner end of said plug rotatably receiving the other of said pin axles, and a spring urged ball operatively mounted in the inner end of said plug resiliently engaging the adjacent end of said magazine; and said magazine further comprises a plurality of substantially hemispherical detents in the end thereof adjacent said plug circumferentially spaced to operatively engage with said spring urged ball to releasably retain said magazine in the respective positions of rotation thereof in which one of said magazine bores is aligned with said blade receiving bore in said blade holder.

* * * * *